United States Patent [19]

Bogue

[11] Patent Number: 4,809,385

[45] Date of Patent: Mar. 7, 1989

[54] FLOOR POLISHING APPARATUS

[76] Inventor: Larry D. Bogue, 10804 E. 63rd St., Raytown, Mo. 64133

[21] Appl. No.: 132,268

[22] Filed: Dec. 14, 1987

[51] Int. Cl.[4] ..... A47L 11/14; A47L 11/40

[52] U.S. Cl. ..... 15/98; 15/230.18; 15/230.19; 15/257 R

[58] Field of Search ..... 15/49 R, 50 R, 49 RB, 15/50 A, 98, 246, 257 R, 385, 230.18, 230.19; 51/272, 273, 274, 177

[56] References Cited

U.S. PATENT DOCUMENTS

| | | | |
|---|---|---|---|
| 1,007,888 | 11/1911 | Parker | 15/49 R X |
| 3,067,549 | 12/1962 | Laverdisse . | |
| 3,148,397 | 9/1964 | Kuchar et al. | 15/49 R |
| 3,527,001 | 9/1970 | Kleemeier et al. . | |
| 3,673,744 | 7/1972 | Oimoen | 51/177 |
| 3,684,325 | 8/1972 | Okun . | |
| 3,701,221 | 10/1972 | Vinella | 51/177 |
| 3,703,739 | 11/1972 | Young et al. . | |
| 4,069,538 | 1/1978 | Fallen . | |
| 4,307,480 | 12/1981 | Fallen | 15/230.18 |
| 4,322,920 | 4/1982 | Wells . | |
| 4,541,207 | 9/1985 | Antonson | 15/230.17 |
| 4,631,775 | 12/1986 | Palmer et al. . | |
| 4,709,439 | 12/1987 | Warren et al. | 15/230.18 |

OTHER PUBLICATIONS

Brochure of Mastercraft Industries, Inc. date of application unknown.

*Primary Examiner*—Edward L. Roberts

*Attorney, Agent, or Firm*—Litman McMahon & Brown

[57] ABSTRACT

An apparatus for imparting a high gloss to a floor including a frame, a motor mounted on the frame, a drive pad operatively rotated by the motor, a buffing pad positioned beneath the drive pad and rotated at about 2200 RPM thereby, and an adjustable shield mounted on the frame. The drive pad is partly and centrally concave such that only a relatively small outer surface area of the drive pad is supported by and drives the buffing pad. Preferably, only about the outer 15% of radius of the drive pad includes engaging projections or the like thereon to engage the buffing pad. The shield is adjustable to allow a lower edge to be placed relatively very close to the floor to prevent the buffing pad from engaging debris, walls or the like and to reduce the amount of dust raised in the air by the polishing. The adjustability of the shield allows for variance in thickness of the buffing pad due to wear or the like.

11 Claims, 2 Drawing Sheets

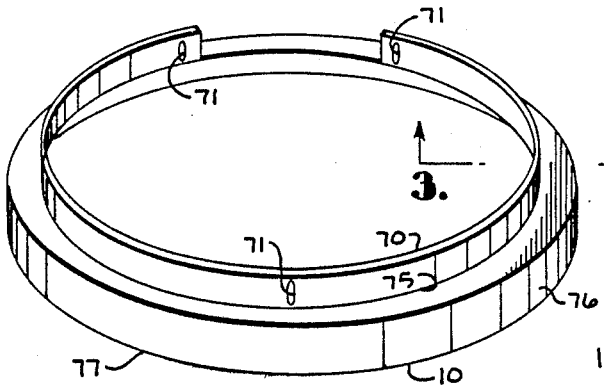
Fig. 2.
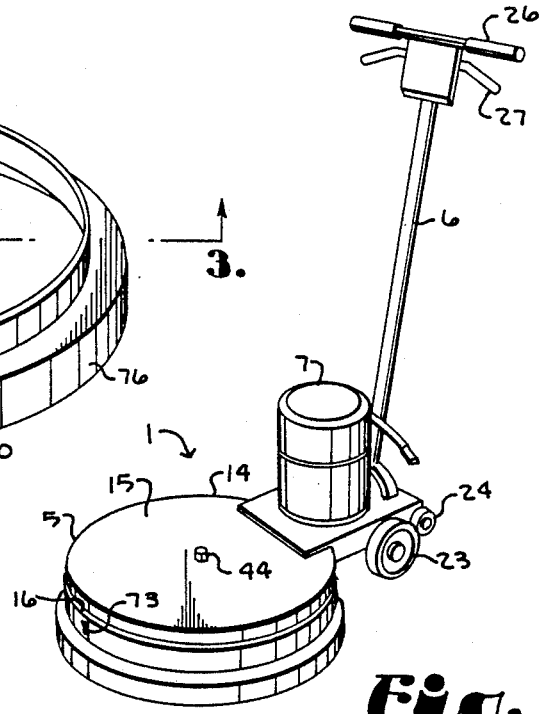
Fig. 1.
Fig. 3.
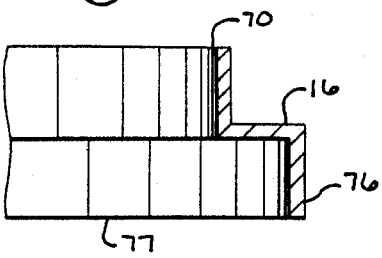
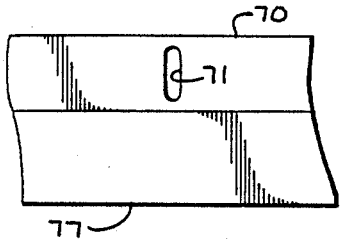
Fig. 4.
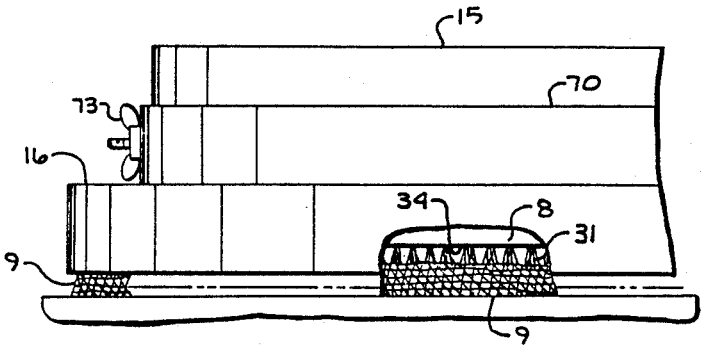
Fig. 5.

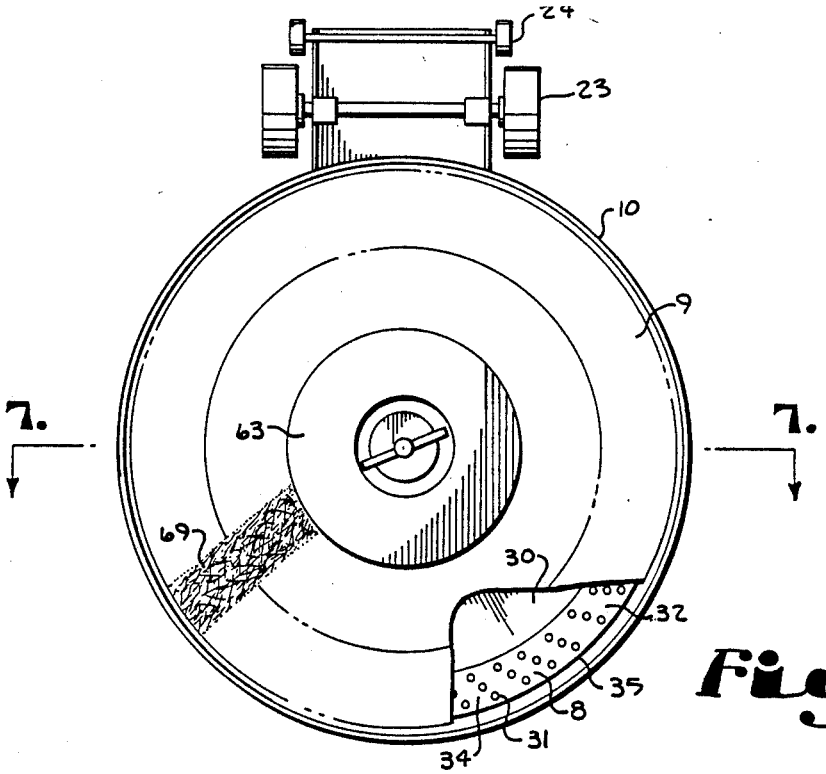
Fig. 6.
Fig. 7.
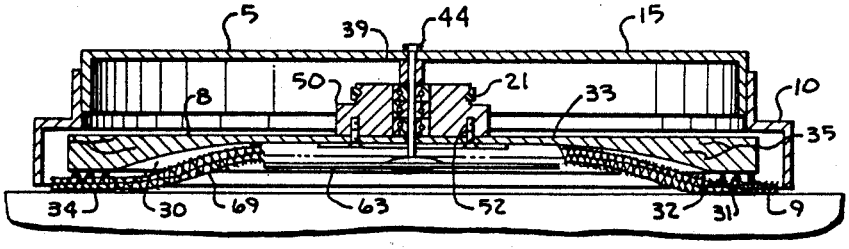
Fig. 8.
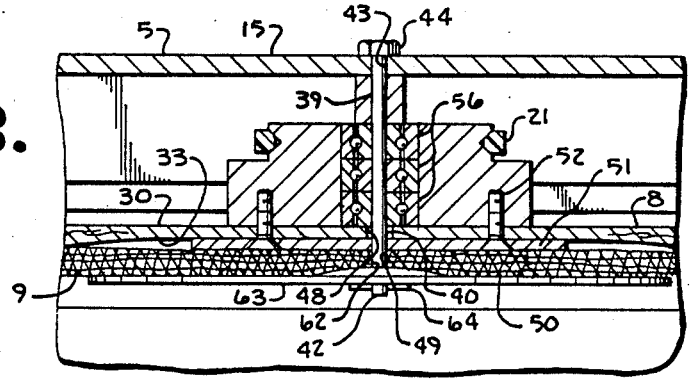

FLOOR POLISHING APPARATUS

BACKGROUND OF THE INVENTION

The present invention relates to devices for polishing floors and, in particular, to relatively high-speed burnishing or polishing devices wherein a buffing pad is rotated by a drive pad.

Over the last several decades, floor polishing machines have improved significantly from machines which rotated between one to two hundred revolutions per minute to conventional machines which have high quality buffing pads and which are capable of rotating at relatively high speeds, for example 2200 revolutions per minute or more, when not under a workload. While conventional machines are a significant improvement over the machines of several decades ago, there are still associated problems.

In particular, unless powered by relatively very large engines (often noisy propane engines), conventional machines powered by smaller and quieter engines normally incur significant drag on the buffing pad during use which reduces the rotational rate of the pad to rotational speeds on the order of 1500 to 1600 rpm with a consequent significant reduction in buffing or polishing quality. Buffing at the lower rates of revolution also requires more passes of the pad over a particular area and, consequently, more operator time than if the pad can be rotated at a higher speed.

Applicant has determined through extensive testing that a significant portion of the shine or gloss applied to a floor during buffing by machines of this type is produced by the circumferential portion of the buffing pad closest to the outer edge of the drive pad. Further, applicant has determined that, if the entire weight of the machine is placed on the buffing pad above this outer portion rather than across the entire buffing pad, substantially less drag is placed on the machine as compared to a similarly powered machine having a buffing pad which supports the weight of the buffing machine across the entire or at least a majority of the surface of the buffing pad.

It is noted that modern buffing pads are designed to operate at relatively high rotational speeds. Consequently, applicant undertook to produce a floor polishing apparatus which would be relatively high-speed, yet which would be designed so that the weight of the buffing machine would be substantially all directed to near the outer edge of the buffing pad in order to both reduce the drag and consequently increase the rotational speed of the pad under load for a particular horsepower motor and to provide additional weight to react against the pad at the location where the pad was performing the greatest amount of polishing.

One further problem associated with the high speed conventional polishing machines is that, if the buffing pad strikes a small object at such high rotational speeds, a significant amount of momentum may be imparted to the object and the object can become a very dangerous projectile. For example, the buffing pad may hit a loose screw, nail or the like that has been accidentally left on the floor and possibly hidden by an overlaying counter or the like. This thrown object may then hit the user of the machine or some bystander with sufficient force to cause injury. These pads also rotate at sufficient speed to cause damage to walls or other objects which they strike. And when the polishing pads strike objects, such objects often catch the pad, partly tearing same and thereby leading to greater wear and early replacement of the pad. Further, the pads tend to distribute a substantial amount of dust into the air around the polisher.

Therefore, applicant determined a protective structure was needed to prevent the pad from engaging loose objects laying on the floor and from coming into contact with walls and the like.

In providing a protective structure, it is also necessary to ensure that the protective structure is adjustable so that an operator may adjust the structure as the buffing pad wears or in accordance with the degree to which the floor is flat or bumpy with the latter requiring a slightly higher setting than the former.

OBJECTS OF THE INVENTION

Therefore, the objects of the present invention are to provide a floor polishing apparatus having a buffing pad rotated by a drive pad rotated at a relatively high speed, for example, 2200 revolutions per minute; to provide such an apparatus wherein a substantial amount of the weight directed against the buffing pad is applied to a relatively small annular section of the pad near the outer edge of the buffing pad; to provide such an apparatus wherein the drive pad is scalloped, dished or concave near the center thereof so as to reduce the amount of weight applied to the buffing pad in this area; to provide such an apparatus wherein substantially all of the weight of the apparatus is applied to the buffing pad by the drive pad along approximately the outer ten to fifteen percent of the radius of the drive pad; to provide such an apparatus having sufficient area of engagement of the drive pad with the buffing pad to prevent excessive wear of the buffing pad; to provide such an apparatus having a depending shroud or shield to prevent small objects from engaging the buffing pad and being propelled as projectiles by the buffing pad; to provide such a shield which prevents the buffing pad from engaging walls and the like and reduces the amount of dust distributed in the air by buffing; to provide such a shield which is both close to the pad to allow the buffing pad to reach tight areas, yet which is adjustable to provide for alternative spacing of the shield from the floor being buffed in order to provide for variance in the buffing pad and variations in the floor; and to provide such an apparatus which is relatively inexpensive to manufacture, relatively easy to use and which is particularly adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a floor polishing apparatus having a drive pad, a buffing pad, and a protective shield in accordance with the present invention.

FIG. 2 is an enlarged and perspective view of the protective shield of the apparatus.

FIG. 3 is an enlarged and fragmentary cross-sectional view of the protective shield of the apparatus, taken along line 3—3 of FIG. 2.

FIG. 4 is an enlarged and fragmentary front elevational view of the protective shield of the apparatus.

FIG. 5 is an enlarged and fragmentary side elevational view of the floor polishing apparatus with portions broken away to show detail thereof.

FIG. 6 is an enlarged bottom-plan view of the floor polishing apparatus.

FIG. 7 is an enlarged cross-sectional view of the floor polishing apparatus, taken along line 7—7 of FIG. 6.

FIG. 8 is an enlarged and fragmentary cross-sectional view of the floor polishing apparatus, taken along line 7—7 of FIG. 6.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a floor polishing apparatus in accordance with the present invention.

The floor polishing apparatus 1 comprises a main housing 5 connected at one end thereof to an operator handle 6, motor means such as the illustrated electric motor 7, a drive pad 8, a buffing pad 9 and a protective shield 10.

The main housing 5 includes a relatively flat cylindrical structure 14 having a top wall 15 and a depending circular member or side wall 16. Neither the top wall 15 or the side wall 16 are continuous near the rear of the structure 14, but rather merge with a rectangularly shaped motor support structure 20, so as to form an opening therebetween to allow drive means including a drive belt 21 to rotate in a generally horizontal plane freely between the motor support structure 20 and the cylindrical structure 14. Mounted toward the rear of the motor support structure 20 are two pairs of wheels 23 and 24 used to transport the apparatus 1 when the apparatus 1 is not in a polishing mode. The motor 7 is secured to the motor support structure 20 by bolts or the like and has a drive pulley (not shown) which rotates in a generally horizontal attitude when the apparatus 1 is in a floor polishing mode and about which the drive belt 21 wraps and is driven.

The operating handle 6 and motor 7 are typical of conventional floor polishing devices. In particular, the motor 7 is electrically driven and has sufficient horsepower after any appropriate gear reduction from the output to drive the drive pad 8 at a relatively high speed, for example, 2200 revolutions per minute. It is noted that, while a rate of rotation of 2200 rpm is specifically discussed herein, the present invention functions well with floor polishers having rotational speeds greater or less than 2200 rpm and applicant does not intend to limit this invention to any specific rotational speed. An electric motor of about one and one-half horsepower when used with the present invention has been found to be satisfactory for this purpose.

The handle 6 is attached to the support structure 20 near the rear thereof and extends upwardly and rearwardly therefrom. The handle 6 includes grips 26 near the upper end thereof to allow an operator to hold and control the apparatus 1. Operator controls 27 for remotely starting and stopping the motor 7 and the like are also provided at the upper end of the handle 6 near the grips 26 to allow the operator control over the apparatus 1, while it is in a polishing mode thereof. The controls 27 are conventional in type and, therefore, substantial detail will not be provided herein relative to such controls.

The drive pad 8 comprises a generally circular plate 30 having buffing pad engagement means such as spikes, teeth or other projections and in the present embodiment comprises a plurality of depending relatively stiff bristles 31. The purpose of the bristles 31 is to engage and generally dig into the rather loose woven fibrous material of which conventional buffing pads, as well as the buffing pad 9, are constructed without tearing the material. The bristles 31 thereby transfer rotational force from the drive pad 8 to the buffing pad 9. The drive pad plate 30 is substantially wider than thick and, as seen in FIG. 7, is centrally concave so as to form a cavity 33 which opens downwardly when the apparatus 1 is in the operative mode thereof. The greatest degree of concavity is in the radially central portion of the plate 30 and the cavity 33 extends outwardly to near the bristles 31. In particular, where the bristles 31 are attached to the plate 30, the plate 30 has an underside 32 which is substantially planar and horizontally aligned when in an operative position thereof.

As seen in FIGS. 7 and 8, the bristles 31 attach to the plate underside 32 and extend downwardly therefrom. The bristles 31 are aligned in approximately three rows in spaced relationship to one another on an annular surface 34 extending from the outer edge 35 of the plate 30 to whereat the the cavity 33 begins. In this manner, a ring of bristles 31 extends downwardly from near the plate outer edge 35. The bristles 31 are utilized to drive the buffing pad 9 and to transfer weight from the remainder of the apparatus 1 to the buffing pad 9, as will be described in greater detail below. The bristles 31 are positioned preferably from about ten to fifteen percent of the radius of the plate 30, that is, along approximately ten to fifteen percent of the outer radius of the plate 30.

The plate 30 is rotatably attached to the housing 5 and, in particular, to the top wall 15 by a support spindle or stud 39. The support stud 39 has a central shaft 40 and a lower treaded end 42. The stud portion 41 extends through an aperture 43 in the top wall 15 and is securely held on one side against the top wall 15 by a head 44 such that the stud central shaft 40 is mounted on the upper top wall 15 and extends downwardly therefrom.

The drive pad 8 includes a central aperture 48 through which the stud 39 passes. A plate 51 is attached by bolts 52 or the like to the drive pad 8 and the stud 39 passes through a central aperture 49 in the plate 51. The aperture 49 allows the drive pad 8 to rotate relative to the stud 39, but positions the axis of rotation of the drive pad 8 to be the same as the longitudinal axis of the stud 39. In this manner, the stud 39 functions as a relatively stationary pin upon which the drive pad 8 rotates. Further, with reference to FIG. 7, the drive pad 8 is secured to a sheave/pulley 50 by the bolts 52. The sheave/pulley 52, in turn, is axially rotated upon the stud 39 on bearings 56.

The drive belt 21 engages and drives the sheave/pulley 52 and consequently the attached drive pad 8, when the motor 7 is activated. A spacer sleeve 60 spaces the bearings 56 and sheave/pulley 50 from the housing top wall 15.

The buffing pad 9 has a rather small central aperture 62 which also is positioned over the stud 39 and is held thereon by a lower connecting plate 63 which is, in turn, secured to the stud 39 by a wide diameter threaded locking nut 64 such that the plate 63 and, more particularly, the buffing pad 9 are free to rotate about the stud 39 when driven by the drive pad 8. The buffing pad 9 is constructed of suitable buffing material of the type conventionally used and preferably is slightly larger in diameter than the drive pad 8 (for example, the drive pad 8 may be 21 inches in diameter and the buffing pad 22 inches in diameter). The bristles 31 of the drive pad 8 rest near the outer periphery of the buffing pad 9 when the apparatus 1 is in an operative mode thereof and tend to sink into the buffing pad 9. In this manner, when the drive pad is motivated to rotate by the motor 7 acting through the drive belt 21 and sheave/pulley 50, the buffing pad 9 is also caused to rotate. The buffing pad 9 has a lower floor engaging surface 66. Generally, only the outer portion of the buffing pad 9 under the bristles 31 engages a floor under pressure. The remainder of the pad 9 is preferably pulled upwardly into the drive pad cavity 33 by the plate 63.

The protective shield 10 is best seen in FIG. 2. The shield 10 includes a circular ring or rim 70 which snugly but slidably fits around the outside of the housing depending member or side wall 16. The rim 70 includes adjustment means comprising three elongate and generally vertically extending slots 71. The slots 71 are aligned to mate with threaded apertures 72 in the side wall 16. Wing bolts 73 or the like pass through the slots 71 into the apertures 72 and are adjustable in order to modify tension of the rim 70 against the side wall 16 to either allow the rim 70 to slide relative to the side wall 16 or to lock the rim 70 in a fixed position relative to the side wall 16 by tightening or loosening against the walls of the slots 71.

Attached to a lower edge 75 of the rim 70 is a flange 76. The flange 76 extends radially outwardly and then downwardly. The inner diameter of the lower part of the flange 76 is sized to be just slightly larger than the outer diameter of the buffing pad 9. When in position on the apparatus 1, the protective shield 10 is positionable such that a lower edge 77 thereof is relatively closely spaced to a floor being polished by the apparatus 1. In this manner, foreign objects are pushed aside by the shield 10 rather than allowed to engage the buffing pad 9 and a substantial amount of the dust raised by the buffing pad 9 is maintained beneath the apparatus 1.

In use, the buffing pad 9 is placed on the apparatus 1, as illustrated in the figures. The shield 10 is adjusted relative to the floor in order to bring the lower edge 77 of the shield 10 close to the floor. The apparatus 1 is then activated by the operator starting the electric motor 7 which, in turn, drives the drive belt 21, the sheave/pulley 52 and subsequently the drive pad 8. The drive pad 8 acts through its depending bristles 31 to both rotate the buffing pad 9 and to transfer substantially the entire weight of the apparatus 1 to the outer buffing surface (where the bristles 31 are located above) of the buffing pad 9. The buffing pad 9 is preferably rotated at relatively high speeds. In this manner, a high sheen is placed upon a floor in a relatively short period of time. Additional weight may be added to the housing 5 to increase the weight acting on the buffing pad 9 where desired. The protective shield 10 prevents the buffing pad 9 from engaging small foreign objects such as screws, rocks or the like that have accidentally fallen onto the floor and, therefore, helps prevent them from becoming projectiles that may endanger the operator or other personnel within the vicinity of the shield 10. The shield 10 also prevents the buffing pad 9 from engaging furniture or walls and thereby damaging same and reduces dust which would otherwise be distributed in the air by action of the buffing pad 9.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for polishing floors comprising:

(a) a support frame;

(b) motor means supported by said frame;

(c) a drive pad operatively supported by said frame and driven by said motor means;

(d) a buffing pad operatively mounted beneath and driven by said drive pad; said drive pad including engagement means for engaging said buffing pad, supporting substantially the remainder of said apparatus on said buffing pad and for rotating said buffing pad; said engagement means being positioned near and substantially continuous around the outer periphery of said drive pad such that substantially the entire weight of said apparatus is supported by a relatively small radius of said buffing pad near the outer periphery thereof; and said engagement means spacing said buffing pad from said drive pad beneath said engagement means;

(e) connecting means spaced from said engagement means for centrally securing said buffing pad to said drive pad and drawing said buffing pad upwardly; and (f) said drive pad having a concave lower surface inward from said engagement means such that said buffing pad inward from said engagement means is substantially held out of engagement with a floor during use to reduce drag by said spacing and by said pad being drawn upwardly near said concave lower surface by said connecting plate means.

2. The apparatus according to claim I wherein:

(a) said engagement means are bristles evenly positioned on the outer portion of a lower surface of said drive pad and extending inwardly from said drive pad periphery not more than 30% of the radius of said drive pad.

3. The apparatus according to claim 1 wherein:

(a) said engagement means extends around substantially the entire periphery of said drive pad and extends less than 30% of the radius of said drive pad inward from said periphery.

4. The apparatus according to claim 3 wherein (a) said engagement means extends inward less than 20% of the radius of said drive pad.

5. The apparatus according to claim 1 wherein (a) said engagement means are bristles evenly positioned over the face of said drive pad from near the periphery of said drive pad inward in a range from about 10 to 15% of the radius of said drive pad.

6. The apparatus according to claim 5 wherein:

(a) said bristles extend inward from said periphery approximately 15% of the radius of said drive pad.

7. The apparatus according to claim 1 including:

(a) a protective shield; said shield being adjustably mounted on said frame and having a lower edge; said shield substantially surrounding an outer periphery of said buffing pad; and (b) adjustment means for adjusting the position of said shield lower edge relative to a lower surface of said buffing pad such that said shield is adapted to be positioned to prevent said buffing pad from engaging objects other than a floor being polished thereby.

8. A floor polishing apparatus comprising:

(a) a main support frame;

(b) motor means supported by said frame;

(c) a buffing pad operably rotated by said drive motor and having a lower floor engaging surface; said buffing pad extending radially outward from said main frame;

(d) an adjustable shield secured to said main frame and having a lower edge; said shield in close proximity to and substantially generally surrounding and covering the periphery of said buffing pad; said shield including adjustment means for adjusting the position of said shield lower edge relative to said buffing pad lower surface whereby said shield is adapted to keep said buffing pad from striking other objects along a floor being polished thereby and limits distribution to the air of dust raised by operation of said buffing pad; and (e) said shield having a lower flange extending radially outward from said main frame and having a thickness and outer radius sized so as to substantially just cover the outer periphery and surround said buffing pad.

9. The apparatus according to claim 8 wherein:

(a) said pad housing includes an outer circumferential downward depending member; and (b) said shield comprises a ring snugly and slidably mounted on said housing depending member when said adjustment means is in a released position.

10. The apparatus according to claim 9 wherein:

(a) said shield mounts radially outward of said housing depending member; and (b) said adjustment means comprises a plurality of elongate vertically aligned slots in said shield, threaded apertures in said housing depending member and fasteners received in said apertures for selectively locking against outer walls of said slots and consequently locking said shield in fixed position relative to said housing depending member.

11. A floor polishing apparatus comprising:

(a) a support frame having an operator handle and a pad covering housing;

(b) motor means mounted on said frame;

(c) a pad support spindle depending from and supported by said housing;

(d) a drive pad rotatably mounted on said spindle and having a generally vertical operative axis of rotation;

(e) drive means operatively rotating said drive pad through said motor means;

(f) a buffing pad positioned beneath said drive pad and being operatively rotated thereby; said drive pad having a lower surface with a plurality of polishing pad engaging projections thereon and a central portion that is concave and opens downwardly; said projections being positioned on said drive pad lower surface from near an outer periphery thereof inward approximately 15% of the radius of said drive pad; said projections spacing said buffing pad from said drive pad beneath said projections;

(g) connecting plate means centrally securing said buffing pad to said drive pad near a top of said drive pad concave central portion and holding said buffing pad radially inward of said projection substantially away from a floor during use;

(h) an adjustable shield; said shield comprising a ring and adjustment means; said ring being slidable along said housing when said adjustment means are positioned to allow relative movement and said ring being locked in position relative to said housing when said adjustment means are locked; said ring having a lower edge that is positionable close to a plane passing through a lower surface of said buffing pad so as to be spaced relatively close to and in radially surrounding relationship to said buffing pad and being lockable there by said adjustment means such that said shield prevents said buffing pad from striking objects on a floor being polished thereby; and (i) said shield having a lower flange extending radially outward from said main frame and having a thickness and outer radius sized so as to substantially just cover the outer periphery of and surround said buffing pad.

* * * * *